United States Patent [19]

Bennett

[11] Patent Number: 4,662,831

[45] Date of Patent: May 5, 1987

[54] APPARATUS FOR FRACTURING EARTH FORMATIONS WHILE PUMPING FORMATION FLUIDS

[76] Inventor: John D. Bennett, Box 428, Marble Falls, Tex. 78654

[21] Appl. No.: 781,690

[22] Filed: Sep. 30, 1985

Related U.S. Application Data

[63] Continuation-in-part of Ser. No. 585,952, Mar. 5, 1984, abandoned.

[51] Int. Cl.[4] ..... F04B 21/00; F04B 7/00

[52] U.S. Cl. ..... 417/430; 417/435; 417/444; 417/514; 417/520; 417/554; 166/106; 166/280

[58] Field of Search ..... 417/259, 260, 430, 435, 417/443, 444, 510, 511, 514, 520, 545, 546, 552, 554; 166/106, 280, 369

[56] References Cited

U.S. PATENT DOCUMENTS

| | | | |
|---|---|---|---|
| 1,240,404 | 9/1917 | Aull | 417/496 |
| 2,171,410 | 8/1939 | Steele | 417/490 |
| 2,263,144 | 11/1941 | Scott | 417/435 |
| 2,544,094 | 3/1951 | Knowles | 417/260 |
| 2,798,557 | 7/1957 | Sewell | 166/280 |
| 3,020,954 | 2/1962 | Graham et al. | 166/369 X |
| 3,055,764 | 9/1962 | Pryor et al. | 417/444 X |
| 3,136,256 | 6/1964 | Chenault | 417/443 |
| 3,280,912 | 10/1966 | Sheffield, Jr. | 166/280 |
| 3,359,917 | 12/1967 | Cooprider | 417/520 X |
| 3,412,797 | 11/1968 | Huitt et al. | 166/280 X |
| 3,417,819 | 12/1968 | Wyllie | 166/280 |
| 3,479,958 | 11/1969 | Anderson et al. | 417/554 X |
| 3,594,103 | 7/1971 | Hillis | 417/435 |
| 3,695,787 | 10/1972 | Kraus | 417/552 X |
| 4,014,629 | 3/1977 | Elsworth | 417/510 X |

*Primary Examiner*—Carlton R. Croyle
*Assistant Examiner*—Paul F. Neils
*Attorney, Agent, or Firm*—M. Lee Murrah

[57] ABSTRACT

Oil and other fluids are pumped from a well drilled into chalk or other difficult-to-produce formations by applying a back pressure to the formation concurrently with pumping fluid from the formation. One embodiment a pump suitable for performing the method includes a reciprocating piston with a check valve to permit the passage of fluid through the piston during downstrokes and to prevent its passage during upstrokes. The pump also includes a second check valve having a telescoping link that permits the downward passage of fluid for a first portion of the downstroke of the pump piston but prevents the passage of the fluid during a second portion of the piston downstroke. The combined action of the two valves is to lift fluid on the pump piston upstroke and force a portion of the previously lifted fluid back into the well, and thus into the formation, during the first portion of the downstroke. The movement of a portion of the fluid back into the formation acts to clear material bridges that block fluid access to the well and also to continuously fracture the formation to enhance fluid entry into the well. In a second embodiment the telescoping link and associated valve are replaced by an elongated, tapered rod which passes through the central opening of annular collar on its downstroke and forces the collar against a valve seat to block the downward passage of fluids. On its upstroke the rod permits the collar to rise from the valve seat to permit the upward passage of fluids.

12 Claims, 9 Drawing Figures

APPARATUS FOR FRACTURING EARTH FORMATIONS WHILE PUMPING FORMATION FLUIDS

BACKGROUND OF THE INVENTION

This application is a continuation-in-part of Application Ser. No. 585,952, filed Mar. 5, 1984, now abandoned.

The present invention relates to pumping apparatus for wells, and more particularly to pumping apparatus for wells producing oil, petroleum products, and the like, and most particularly to pumping apparatus for removing oil and the like from dense formations.

There are several types of petroleum formations that are of such low permeability that the passage of petroleum into the wellbore is impeded. One such formation is composed of chalk, an example of which is the Austin Chalk formation in South-Central Texas. It is characteristic of oil wells in the Austin Chalk to produce large amounts of petroleum products early in the life of the well but to rapidly diminish to very small amounts. In order to increase production, wells are often fractured using high pressure fluids. This "fraccing" creates cracks in the formation which are propped open using sand and small gravel. This opens the wellbore to permit entry of larger quantities of petroleum products. In the Austin Chalk and similar formations, however, fraccing enhances production only for a limited time. Eventually even the fractures close, and production again diminishes.

The reason for such difficult production in these types of formations is that materials such as chalk flow with time. Small grains of the formation break off and are carried toward the wellbore by the petroleum and other formation fluids. Since the flow of fluids converges radially on the well bore, the particles are compacted as they approach the wellbore. The problem is compounded by the fact that the velocity of the fluids increases in inverse proportion to distance from the wellbore, which pushes the particles together with more force as they become more compacted as they approach the wellbore. Eventually the particles form a "bridge" and clog fluid access to the wellbore, a process that is analogous to attempting to force sand through a funnel.

SUMMARY OF THE INVENTION

The present invention in one aspect comprises a pump for lifting liquids from a well in an earth formation and concurrently fracturing the earth formation. This is accomplished using a pump of the reciprocating piston variety and providing a first valve that permits a quantity of the liquid to be gathered on the downstroke of the pump and lifted during the upstroke of the pump and a second valve that permits a portion of the formation liquids to be forced back into the earth formation during a first portion of the downstroke of the pump and that prevents further passage of fluids back into the formation during a second portion of the downstroke of the pump.

In another aspect the invention comprises a third valve for venting formation gases from the interior of the pump near the top of the pump upstroke in order to prevent cushioning of the force of the pump downstroke due to the compressibility of such gases.

In still another aspect the invention comprises placing the pump at the level of the formation from which liquids are to be lifted and placing a packing between the pump and the wall of the well near the bottom of the pump in order to prevent the accumulation of compressible formation gases that would diminish the fracturing effect on the earth formation.

BRIEF DESCRIPTION OF THE DRAWINGS

The invention may be more fully understood by reading the following description in conjunction with the appended drawings wherein.

DETAILED DESCRIPTION OF THE PREFERRED EMBODIMENTS

The present invention solves the problem of clogging of earth formations adjacent a well by providing a repetitive backwash action during the time that the well is being produced, thus stimulating production. The action of the backwash is such that clogging particles that may have been drawn toward the well are dislodged from and forced back into the formation away from the well, and the formation is continuously fracced in small increments. This which produces the same benefits on a continuous basis as the much more expensive and complicated frac jobs that are often used to restore clogged wells to their previous productive capacity.

Figure 1:
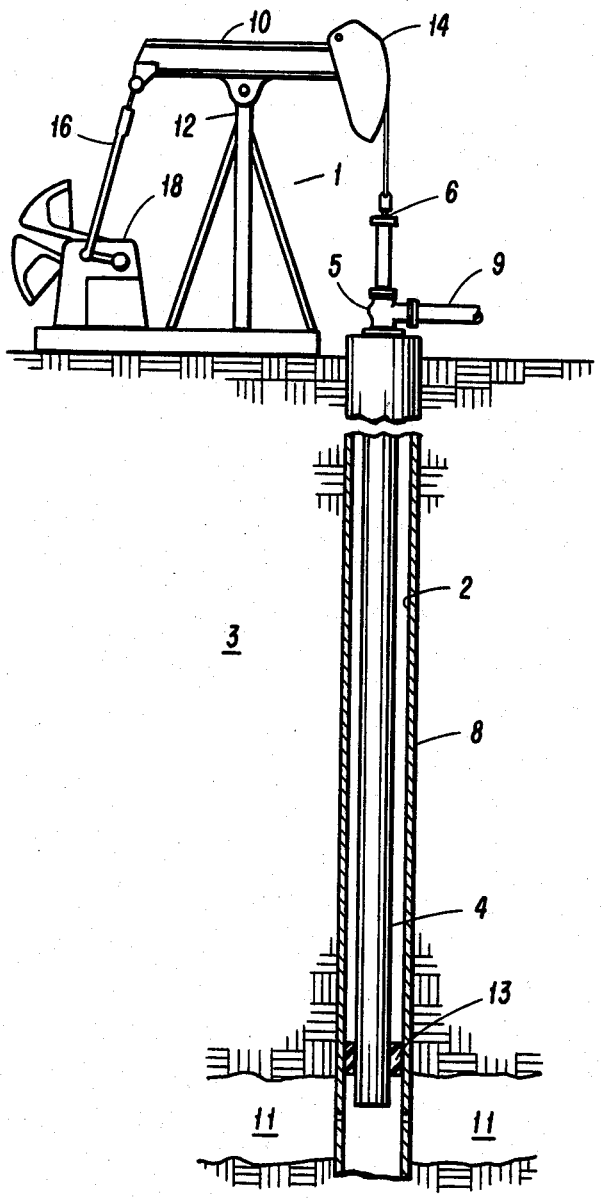
FIG. 1 is a cross-section of a producing oil well which is being pumped by a rocking beam type pumping unit and sucker rod type downhole pump.

The invention would typically be used in connection with a rocking beam type pumping unit and downhole sucker rod type pump as illustrated in FIG. 1. In the typical installation a pumping unit 1 is positioned above a well 2 in an earth formation 3. Pumping unit 1 is connected to a downhole pump 4, which is positioned adjacent an oil bearing producing formation 11, through a wellhead assembly 5 by means of a sucker rod 6 positioned inside production tubing 7. The inside wall of well 2 is lined with a tubular casing 8 to prevent the well wall from caving in. The pumping unit comprises a beam 10 movably attached to a pivot 12. The sucker rod 6 is attached to one end of beam 10 by means of a "horse head" 14. The other end of the beam is connected by means of a rod 16 to a reciprocating gear assembly 18, which is driven by a motor (not shown).

When the reciprocating gear assembly 18 is rotated by its associated motor, the rotary motion is translated to linear motion through rod 16. This causes beam 10 to rock up and down on pivot 12, which in turn causes the sucker rod 6 to move up and down inside tubing 7. The linear vertical motion of sucker rod 6 causes operation of downhole pump 3 as hereinafter described. Petroleum is lifted through production tubing 7 and is transmitted at the surface to a tank through a production flow line 9.

Although the principle of repetitive, backwash during pumping would preferably be incorporated into the pump itself, as hereinafter described, the general principle is best illustrated by the generalized embodiment shown in FIG. 2. In addition to tubing string 7, a second tubing string 20 is also positioned inside casing 8 and extends to the producing formation 11 in the same manner as tubing string 7. Second tubing string 20 has positioned in the lower end thereof a piston 22 which has a piston rod 24 extending to the surface of well 2. Sucker rod 6 is interconnected with a gear 26 by means of a connecting rod 30. Gear 26 is meshed with a second gear 28, which is interconnected with piston rod 24 by means of connecting rod 32.

Figure 3:
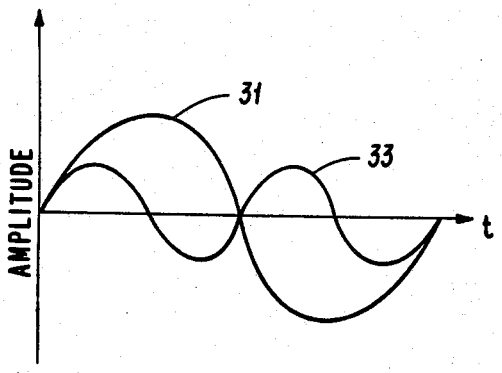
FIG. 3 is a graph illustrating the manner in which the elements of FIG. 1 operate together.
Figure 2:
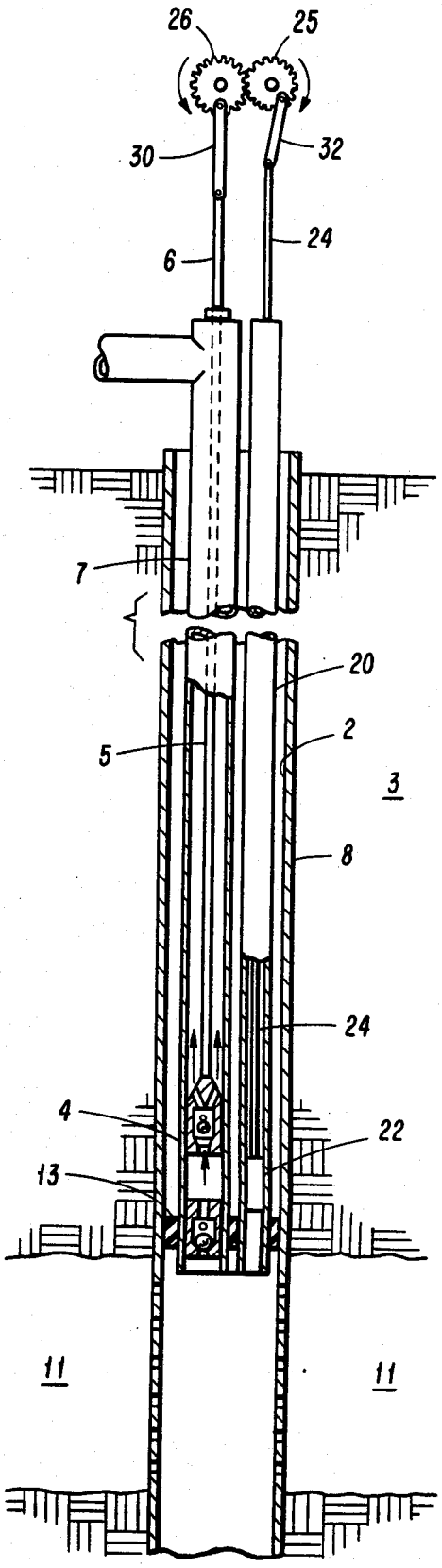
FIG. 2 is a cross-section of a downhole sucker rod pump and associated apparatus for carrying out the invention in a generalized manner.

The operation of the apparatus of FIG. 2 is illustrated by the graphic presentation of FIG. 3. The rotation of gear 26 is transformed into reciprocating linear motion of sucker rod 6 by means of connecting rod 30. The resulting vertical reciprocating motion of the piston in pump 7 can be represented by curve 31. The rotation of gear 28 likewise causes piston 22 to move in a vertical reciprocating motion as represented by curve 33. The action of piston 22 is to provide pressure pulses to the formation concurrent with the pumping action of pump 4. The smaller diameter of gear 28 with respect to gear 26 results in a higher frequency for curve 33 than curve 31. Curves 31 and 33 as drawn imply that gears 26 and 28 are sized to provide an exact multiple of two in rotational speed, but such an exact relationship is not critical to the invention. However, it is preferable that the frequency of the backwash pressure represented by curve 33 be at least equal to the frequency of the pumping action as represented by curve 31, and the phase relationship between curves 31 and 33 be chosen such that piston 22 begins a downward stroke just as sucker rod 6 begins its downward stroke. In general, the amplitude of curve 33 is substantially smaller than that of curve 31 since the objective is to keep the blocking particles in a suspended state.

It should be understood that gears 26 and 28 are used only for purposes of illustrating the principle and that gear 26 is a symbolic replacement for pumping unit 1. Gear 28 might be replaced with a linear electric motor, or the like.

Figure 4:
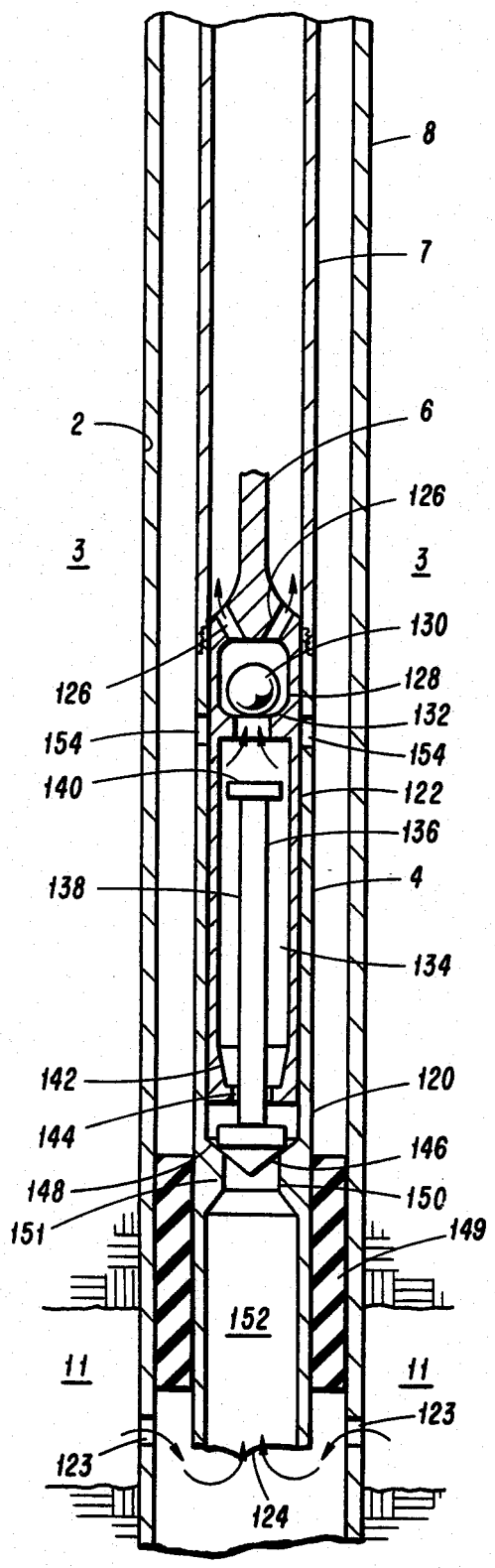
FIG. 4 is a cross-section of a preferred embodiment of a pump for carrying out the present invention in which the pump piston is at the bottom of its stroke.
Figure 5:
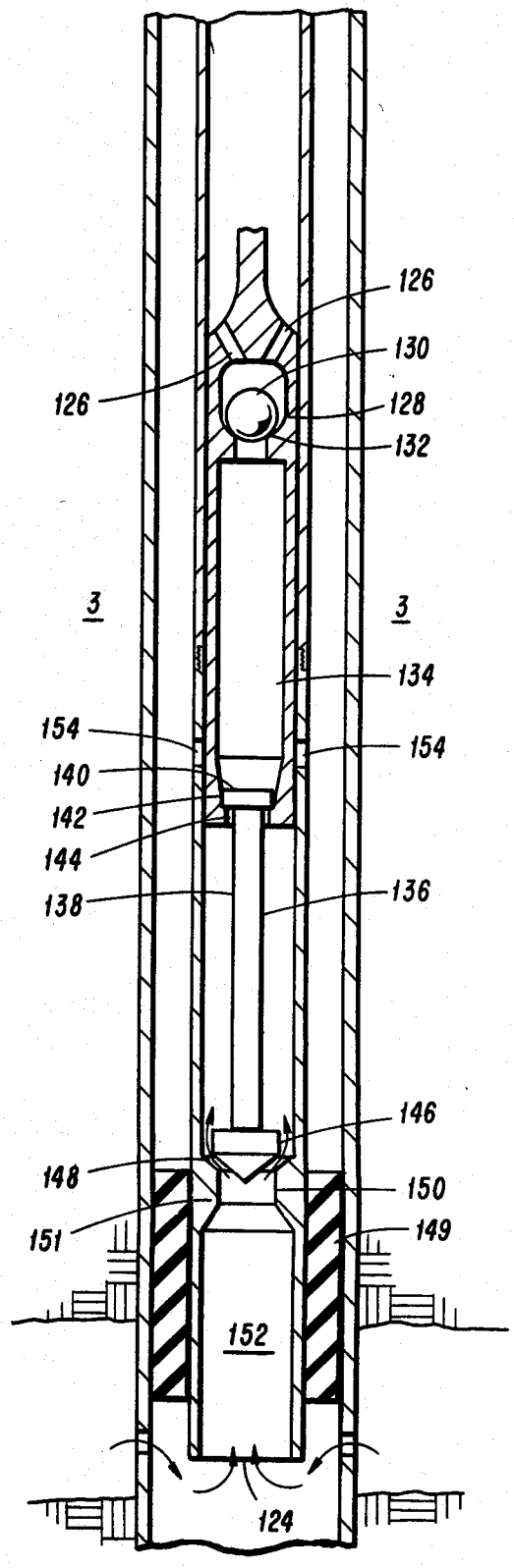
FIG. 5 is a cross-section of the pump of FIG. 4 in which the pump piston is slightly above the bottom of its stroke.
Figure 6:
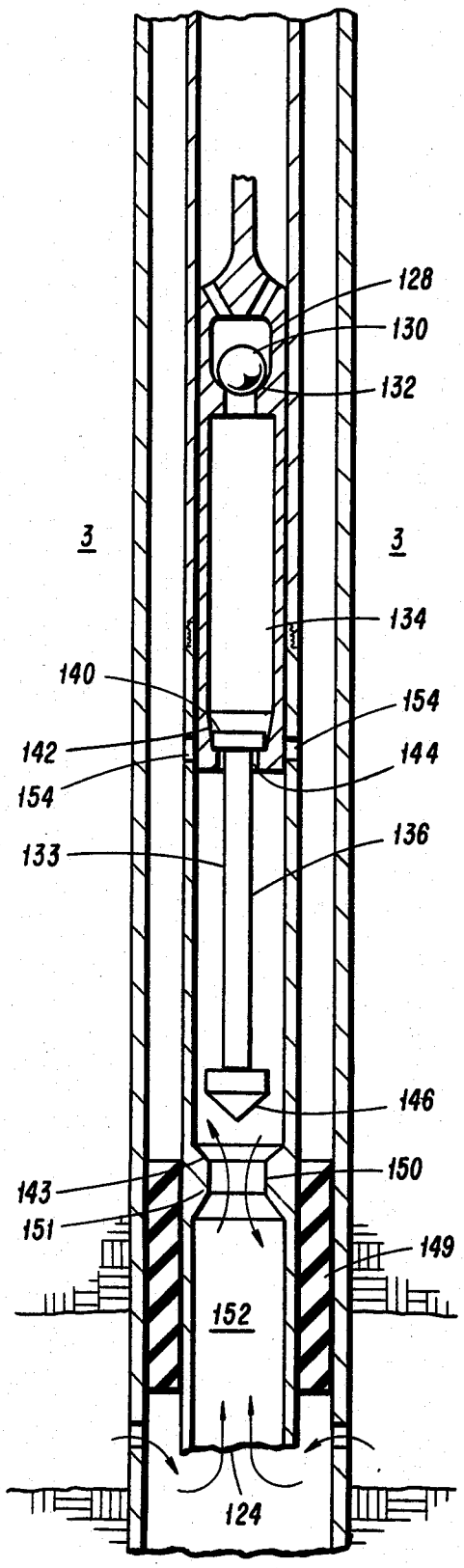
FIG. 6 is a cross-section of the pump of FIG. 4 in which the pump piston is slightly below the top of its stroke.

FIGS. 4–6 show a first embodiment of the downhole pump 4 in various sequential stages of its operation. The construction of pump will be described in detail in connection with FIG. 4.

Pump 4 is connected to production tubing 7 by threaded coupling (not shown) or other means well known in the art. The pump 4 and tubing 7 form an integral unit centrally positioned inside casing 8, which is set by means of cementing, or the like, in well 2 in the earth formation 3.

Pump 4 comprises generally a cylindrical outer casing, or housing, 120 and a cylindrical piston 122 slidably positioned inside housing 120 and sized to prevent the passage of substantial amounts of fluids therebetween. Piston 122 is connected to sucker rod 6 by threads or other similar means, such that reciprocating motion of sucker rod 6 reciprocatingly moves piston 122 inside housing 120. Piston section 122 is generally hollow to permit the upward passage of well fluids which enter through the lower end thereof and exit through a plurality of channels 126 in the upper end of piston section 122 that open into the annulus of production tubing 7 adjacent sucker rod 6. Casing 8 has perforations 123 to permit the entry of well fluids from a producing formation 11.

Although the present embodiment shows piston 122 moving inside housing 120, a design in which piston 122 is stationary and housing 120 moves is also comtemplated by the present invention.

Directly below channels 126 is a check valve comprising an upper valve chamber 128 in which is positioned a movable ball valve 130. Upper valve chamber 128 is elongated along the the vertical axis of piston 122 to permit ball valve 130 to move vertically therein. The inside diameter of upper valve chamber 128 is sized larger than ball valve 130 to permit the passage of well fluids therearound. Alternatively, the inside diameter of upper valve chamber 128 may be only slightly larger than the diameter of ball valve 130, and the passage of fluids permitted by vertical flutings in the inside wall of chamber 128. The lower end of upper valve chamber 128 tapers to an opening forming a valve seat 132 whose diameter is smaller than that of ball valve 130.

Figure 7:
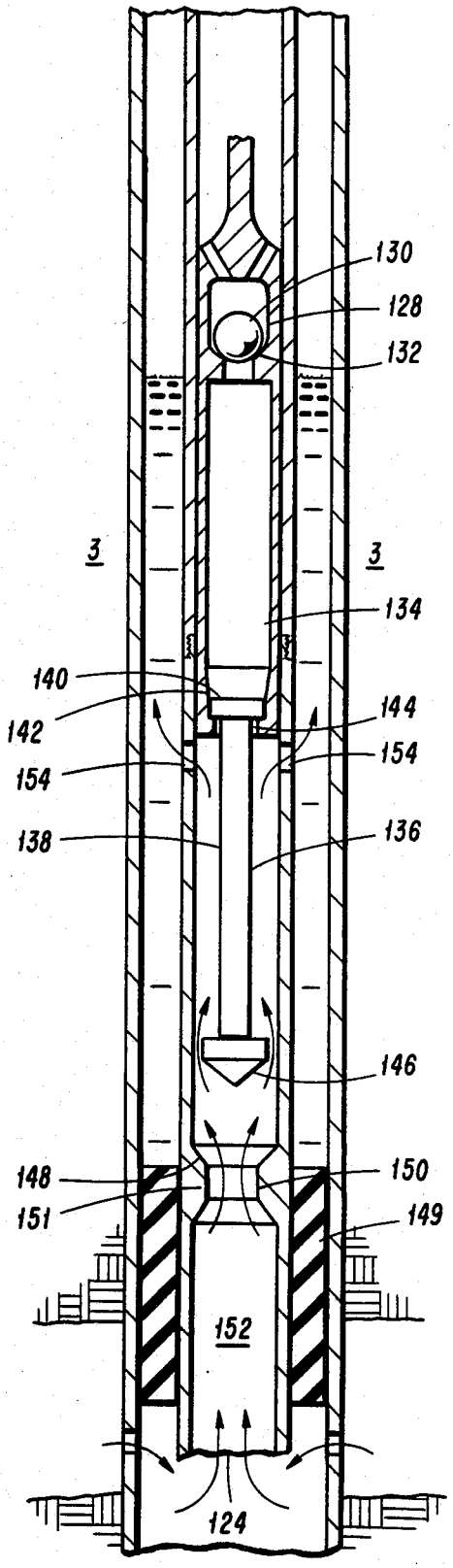
FIG. 7 is a cross-section of the pump of FIG. 4 in which the pump piston is at the top of its stroke.

Below valve chamber 128 and valve seat 132 is an elongated lower valve chamber 134 in which is positioned a telescoping link 136 attached to a valve head 146. Telescoping link 136 comprises an elongated neck portion 138 having an enlarged cylindrical retainer 140 on the upper end thereof. Retainer 140 is sized larger than neck 138 but smaller than the inside diameter of lower valve chamber 134 to permit the flow of well fluids therearound. The lower section of lower valve chamber 134 elongatedly tapers down in size to form a lower valve seat 142 shaped for engagement with valve head 146. The tapering of the lower section of lower valve chamber acts as a shock absorber for cylindrical retainer 140 when the telescoping link 136 reaches its fullest extension as shown in FIG. 5–7. Lower valve seat 142 is sized smaller than retainer 140 to restrain the travel of telescoping link 136 and maintain it in engagement with chamber 134. Lower valve seat 142 has a cylindrical opening or bore, 144 through which passes neck 138 of telescoping link 136. The diameter of opening 144 is slightly larger than the diameter of neck 138 to permit the passage of well fluids and to permit neck 138 to slide up and down in opening 144. The lower end of neck 138 of telescoping link 136 is integrally connected to a conically-shaped valve head 146.

The lower end of lower valve chamber 134 tapers down in size to form a valve seat 148 and cylindrical opening 150, the combination thereof forming a standing valve 151. Cylindrical opening 150 communicates with a fluid entry chamber 152, the lower end of which forms lower end 124 of housing 120. The annular area between pump housing 120 and well casing 8 is sealed by means of packing 149. It is important to the invention that the pump housing 120 not extend significantly below the lower edge of packing 149. Otherwise a pocket for the collection of well gases is formed. Since well gases are compressible, such a gas pocket would absorb the shock of the downward motion of piston 122

(to be described hereinbelow) which is so important to the invention.

Another important feature of the invention is a plurality of openings in the housing 120 of pump 7. Openings, or vents, 154 are positioned about the periphery of housing 120 in order to permit the exit of well gases when the piston 122 reaches the uppermost extent of its travel. Openings 154 also permit well liquids to flow into the annulus between the well casing 8 and the production tubing 7 when the pump is not operating, thereby providing a reservoir. When the pump begins operation, the liquid is pumped back through openings 154 and is pumped to the surface. Openings 154 are located such that piston section 122 just clears such openings at the upper extent of its reciprocating motion. In the alternative, the openings 154 might be positioned elsewhere by arranging the pump assembly to trip a valve when the piston 122 reaches the uppermost extent of its travel as shown in FIG. 7. Such a valve might either be mechanically linked to the tripping mechanism or might comprise an electrically-operated valve and the triggering mechanism a limit switch.

The operation of the pump embodying the present invention is illustrated in FIG. 4–7, which show successive stages in the reciprocation of piston section 122 inside housing 120. FIG. 4 shows piston 122 in its bottommost position in its reciprocation cycle. The lower rod valve is closed by the seating of valve head 146 in valve seat 148 thereby preventing the passage of well fluids thereabove back into fluid entry chamber 152. At the same time new well fluids are entering entry chamber 152 through perforations 123 as symbolically illustrated by the associated arrows. The length of neck 138 of the telescoping link 136 is sufficiently long that the valve head 146 enters valve seat 148 well before the piston 122 reaches the bottommost extent of its travel. The time prior to engagement of valve head 146 with valve seat 148 defines a first portion of the downstroke of piston 122 during which fluids are permitted to flow back into the formation, and the time after such engagement defines as second portion of such downstroke in which fluids are prevented from reentering the formation. As piston 122 continues downwardly and as lower rod valve neck 138 slides through opening 144, well fluids in the annulus of pump housing 120 are displaced and forced upwardly through opening 144, past piston neck 138 and retainer 140, through upper valve chamber 128, and finally through channels 126 into the annulus of production tubing 7 above pump 4. The upward motion of well fluids unseats ball 130 from its seat 132 during this process.

FIG. 5 shows the piston 122 shortly after it begins its upward travel. The cessation of upward movement of well fluids permits ball 130 to settle into valve seat 132, thereby preventing the passage of such fluids back into lower valve chamber 134, and ultimately back into the producing formation 11. The upward travel of piston 122 therefore lifts the column of well fluids in the annulus of production tubing 7 above pump 4. The unseating of valve head 146 in valve seat is delayed until piston 122 moves sufficiently to catch retainer 140. When this occurs the lower valve is opened and well fluids are permitted once again to flow through opening 150.

FIG. 6 shows piston 122 as it nears the top of its stroke. All conditions except one remain as they were in FIG. 5. Valve head 146 is now unseated and fluid communication is now permitted between fluid entry chamber 152 and the area vacated by piston 122. FIG. 7 shows piston 122 at the topmost point of its stroke. Again all conditions remain the same as in FIG. 6 except one. Piston 122 is sufficiently high at the top of its stroke to uncover vents 154 to permit the escape of any well gases to escape to the annular area between casing 8 and production tubing 7 as shown symbolically by the associated arrows. As previously stated this removes any compressible gas that would cushion the shock imparted by the downwardly moving piston 122 as hereinafter described.

On the downward stroke of piston 122 the apparatus previously described operates similarly but in reverse order. The primary difference on the down stroke is the presence and activity of the column of well fluid in tubing 7 above pump 4. On the downstroke piston 122 again attains the position shown in FIG. 6. As piston 122 descends the well fluids that have previously passed through opening 150 to fill the void left by piston 122 when it moved upwardly previously are forced downwardly back through opening 150 and out through end 124 of pump 4. The fluids are then forced back into producing formation 11 by a force whose magnitude is equal to the weight of the fluid column above piston 122 in tubing 7. Thus, the entire weight of the fluid column above the pump is placed on the formation while losing only a small, predetermined amount of the fluid.

Movement of the fluid back into the formation dislodges any loose particles that may have been drawn toward well 2 from producing formation 11 and forces these particles back into the formation. The result of this action is to open up the well to permit fluids to more freely flow into the well on the next upstroke of piston 122. The force of the retreating fluids also tend to cause cracks in the formation into which some of the previously-mentioned loose particles are forced. The loose particles act to prop the cracks in the formation open, which further enhances the entry of well fluids into well 2 where they can be raised to the surface by pump 4. This process is analogous to the intentional process of "fraccing" the formation to create cracks and injecting sand or other material to act as a proppant to keep the cracks open. The operation of the present invention is to automatically fracture the formation as part of the pumping process without the necessity of a separate and very expensive frac job.

The frac portion of the downward stroke of piston 122 lasts only a small portion of the total downstroke. When piston 122 again reaches the position shown in FIG. 5, opening 150 is closed and fluids can no longer pass therethrough. At the point the frac portion of the stroke ceases and the pump portion begins. As previously described in connection with FIG. 4, piston 122 displaces well fluids, and they pass through pump 4 and into the annulus of production tubing 7 above piston 122.

The ratio of the frac portion of the downward stroke of piston 122 to the pump portion is dependent upon the length to neck 138 relative to the overall length of the piston stroke. Thus, by changing the length of lower rod valve neck 138, the amount of the piston stroke devoted to fraccing can be altered. Different formations may require amounts of fraccing for optimum production and pumps in accordance with the present invention can be customized to each formation for best operation.

Figure 8:
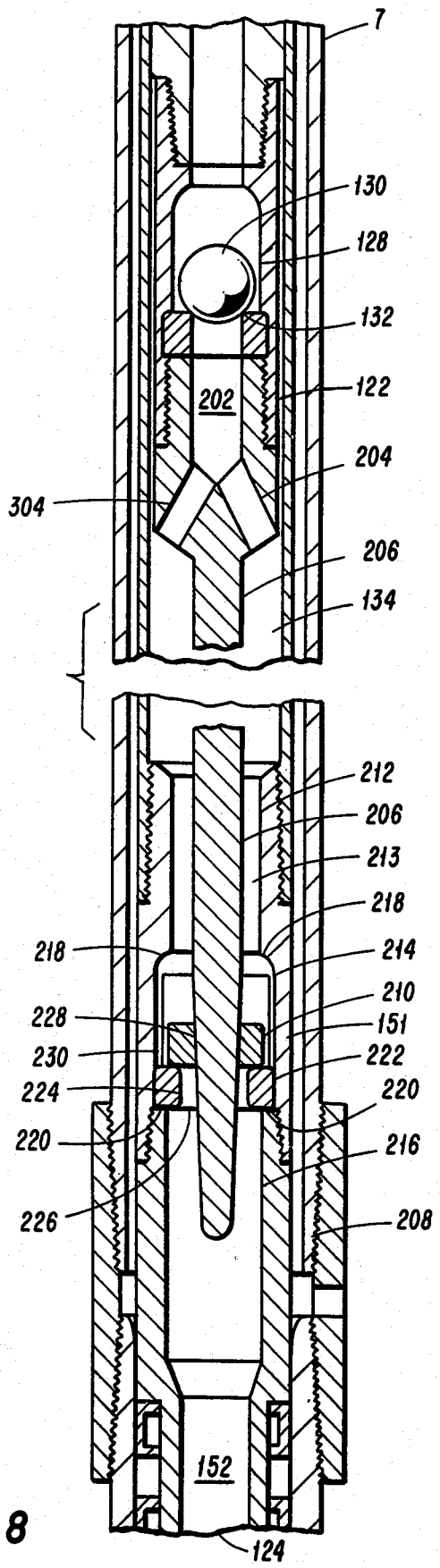
FIG. 8 is cross-section of the pump of FIG. 4 illustrating an alternate preferred embodiment of the lower valve and showing the lower valve in its closed state.
Figure 9:
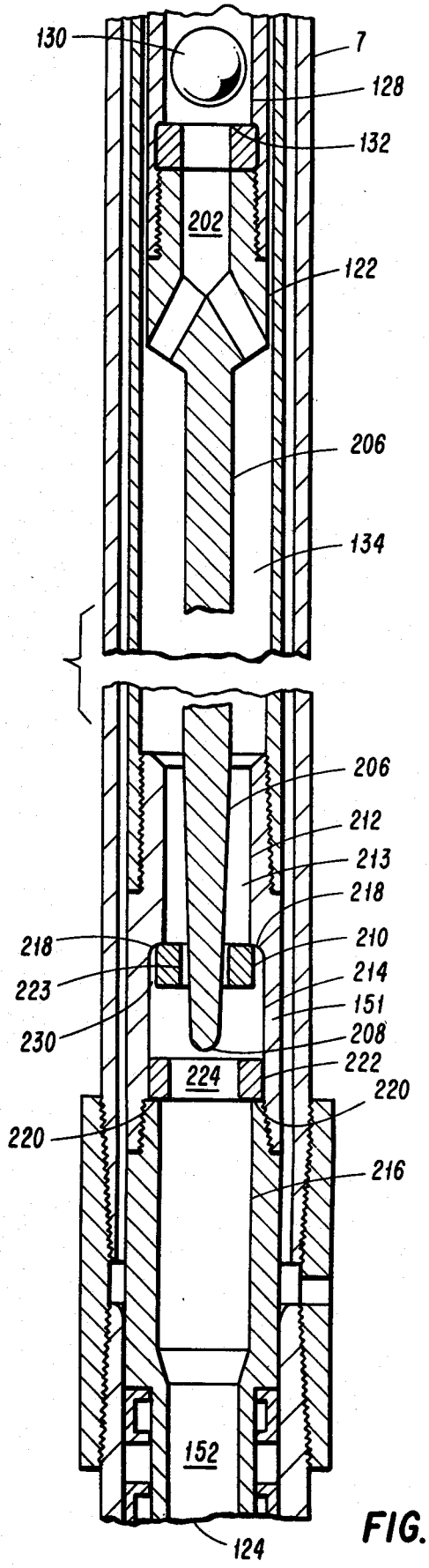
FIG. 9 is a cross-section of the lower valve of the embodiment of FIG. 8 in which the lower valve is in the open state.

An alternative embodiment for the lower valve formed by valve head 146 and seat 148 in FIGS. 4–7 is shown in FIGS. 8 and 9. In this embodiment the upper section of piston 122, including valve chamber 128, ball valve 130, and valve seat 132, is the same as that of the previously described embodiment. A central bore below valve chamber 128 communicates through two vents 204 to lower valve chamber.

Piston 122 has centrally attached to the bottom end thereof an elongated valve rod 206 whose diameter is tapered downward in size toward its lower end 208. The lower end 208 is preferably rounded to provide easy passage through the valve collar to be hereinafter described. Below lower valve chamber 128 is a slightly smaller diameter cylindrical chamber section 212. Directly below chamber section 212 is a slightly larger diameter chamber section 214, which itself has directly below it a slightly smaller restricted diameter chamber section 216. The transition in diameter between chamber sections 212 and 214 form an inverted ledge, and the transition in diameter between chamber sections 214 and 216 form a second ledge 220. Valve rod is positioned and sized to pass through all of chamber sections 134, 212, 214, and 216 as it moves in its reciprocating upward and downward motion and to leave an annular gap 213, for example, at all points along its length.

Chamber section 214 whose length is defined by ledges 218 and 220 has positioned therein an annular valve seat 222 resting on lower ledge 220 and an annular valve collar 210 which in the nonoperational state rests atop annular valve collar 210. However valve collar 210 is free to move upwardly until it contacts upper ledge 218. The central opening 224 in valve seat 222 is significantly larger in diameter than valve rod 206 when valve rod 206 is in its farthest downward position such that an annular gap 226 is created. On the other hand the central opening 228 in annular valve collar 210 is only slightly less than that of valve rod 206 when valve rod 206 is in its farthest downward position. Thus, a seal is provided between valve collar 210 and valve rod 206 in the downwardmost position of rod 206. Although not shown this seal could be enhanced by the use of an O-ring embedded in the interior circumference of opening 228 and a flexible packing on top of valve collar 210. The outside diameter of valve collar 210 is significantly less than that of chamber section 214 such that an annular gap 230 is created therebetween. In addition, its diameter is slightly larger than that of chamber section 212.

In the operation of the alternate embodiment of standing valve 151, the valve reaches its lowest point in its up and down reciprocating cycle as shown if FIG. 8. At this point valve collar 210 is resting on ledge 220 and its central opening is occupied by valve rod 206, thus creating a seal preventing the passage of production fluids downwardly back into the bottom of the well. As piston 122 begins its upward stroke, ball 130 seats against valve seat 132 and the production fluids above ball 130 are lifted. In addition, the upward motion of piston 122 lowers the pressure in chamber section 134, which causes production fluid in fluid entry chamber 152 to begin to rise. This rise of fluid forces valve collar upwardly, thereby keeping it at essentially the same relative position on valve rod 206 as when valve rod 206 is in its bottom most position. This immediately opens standing valve 151, and fluid rushes around valve collar 210 through annular gap 230, through annular gap 211 in chamber section 212 and into chamber section 134.

As valve rod 206 and valve collar 210 continue to rise, valve collar 210 will eventually encounter upper ledge 218, which restrains it continued upward movement. However, valve rod 206 continues to move upwardly, thus clearing central opening 228 in valve collar 210 to permit fluid to continue to pass upwardly into valve chamber 134.

When piston 122 reaches the uppermost point of its cycle and begin its downward motion, ball 130 seats against seat 132, thereby restraining the production fluid above it from reentering chamber 134. Fluid already in chamber 134 is forced back into the well, thereby providing the backwashing or fraccing action. The pressure with which the fluid is forced back into the formation is determined by the weight of fluid above ball 130. The maximum pressure is limited to the weight of the fluid column between the pump and the surface since ball 130 will not remain seated at pressures in excess of that.

As the backwash continues valve collar settles onto valve seat 222. However, since valve rod 206 has not yet filled the central opening 228 in valve collar 210, fluid continues to pass through central opening 228. As valve rod 206 continues to move downwardly, the tapered rod fills more and more of central opening 228 until the standing valve is closed. As valve rod 206 continues to move downwardly, ball 130 is unseated, thereby forcing the remainder of the production fluid in chamber 134 to pass into the production tubing above the pump.

Thus, standing valve 151 provides a fast opening and slow closing valve, which permits an immediate movement of production fluids as soon as piston 122 begins its upward movement and slow valve closing to prevent hydraulic "hammering," which could be destructive to the pump and other production equipment. Although not shown in FIGS. 8 and 9, the pump casing could be provided with openings similar to 154 in FIGS. 4–7 near the uppermost point of travel of piston 122 to permit well gases to bleed into the annulus between the tubing 7 and the casing 8.

While particular embodiments of the present invention have been shown and described, it is obvious that changes and modifications can be made therein without departing from the true scope and spirit of the invention. It is the intent in the appended claims to cover all such changes and modifications.

What is claimed is:

1. A pump for lifting liquids from a well, comprising:

a housing having a cylindrical void therein;

a cylindrical piston slidably positioned in the housing and having a channel passing therethrough;

means for reciprocatingly moving the piston in said housing to produce an upstroke and a downstroke;

a first valve in the channel in said piston arranged to permit the upward passage of the liquids therethrough during the downstroke of said piston and to prevent the downward passage of said liquids therethrough during the upstroke of said piston;

a second valve in said channel in said piston arranged to permit the downward passage of said liquids therethrough during a first portion of said downstroke and to prevent the downward passage of said liquids therethrough during a second portion of said downstroke;

whereby a portion of the liquids produced during the previous pump stroke is forced back into the producing formation to dislodge any loose particles that may have been drawn toward the well and to force said particles back into the formation to thereby continuously fracture the formation and enhance fluid entry into the well; and a third valve positioned below said piston when said piston is at the topmost extent of its stroke, whereby well gases may be vented through said housing.

2. A pump in accordance with claim 1 wherein the first valve is positioned above the second valve and said third valve comprises an opening in said housing.

3. A pump in accordance with claim 2 wherein said first valve comprises:

a first valve seat formed in said channel; and a ball for engagement with the first valve seat.

4. A pump in accordance with claim 3, wherein said second valve comprises;

a second valve seat formed in said channel;

a valve head for engagement with the second valve seat; and a telescoping link slidably attached to said piston.

5. A pump in accordance with claim 4 wherein said telescoping link comprises:

an elongated member attached to said valve head;

an elongated chamber in said piston closed on the lower end thereof and having an opening therein to slidably receive the elongated member; and a retainer on the upper end of said elongated member to maintain said elongated member in the opening in said elongated chamber;

said elongated member being of a length sufficient to engage said second valve seat only near the bottommost extent of said downstroke of said piston.

6. A pump in accordance with claim 5 further including a packing between said housing and the wall of said well.

7. A pump in accordance with claim 6 wherein said packing is positioned adjacent the bottom of said housing.

8. In a reciprocating pump for lifting fluids from a well, having a housing, a reciprocating piston therein having an upstroke and a downstroke, and a check valve for permitting the passage of fluids on the downstroke and for preventing the passage of fluids on the upstroke, the improvement comprising:

a valve seat formed in said housing;

a valve head for engagement with the valve seat;

an elongated chamber in said piston having an opening in the end thereof;

an elongated member attached to said valve head and slidably positioned in the opening in the elongated chamber, said member having a retainer on the end thereof to maintain said elongated member positioned in said opening in said elongated chamber;

said elongated member having a length appropriate for holding said valve head from engagement with said valve seat during a first portion of said downstroke and for permitting said valve head to engage with said valve seat during a second portion of said downstroke;

a valve comprising an opening in said housing, positioned below said piston when said piston is at the top of its stroke;

means, comprising the reciprocating motion of said piston, for opening said valve at the top of said upstroke to vent well gases through said housing; and packing means positioned between said housing and the wall of said well adjacent the lower end of said housing.

9. The improvement in accordance with claim 8 wherein the interior of said elongated chamber adjacent said opening is elongatedly tapered for cushioning said retainer.

10. In a reciprocating pump for lifting fluids from a well, having a housing, a reciprocating piston therein having an upstroke and a downstroke, and a check valve for permitting the passage of fluids on the downstroke and for preventing the passage of such fluids on the upstroke, the improvement comprising:

a valve seat formed in the housing;

a valve head for engagement with the valve seat;

a telescoping link comprising an elongated tapered chamber in the piston, having an opening in the end thereof, an elongated member on the valve head, slidably positioned in the opening in the elongated chamber, and a retainer on the elongated member to maintain said elongated member positioned in said opening in said elongated chamber, whereby said valve head is held from engagement with said valve seat during a first portion of said downstroke and for permitting said valve head to engage with said valve seat during a second portion of said downstroke, such that fluids are permitted to flow back into the well during said first portion and for preventing the same during said second portion;

whereby a portion of the fluids is produced during the previous pump stroke is forced back into the producing formation to dislodge any loose particles that may have been drawn toward the well and to force said particles back into the formation to thereby continuously fracture the formation and enhance fluid entry into the well;

a second valve comprising an opening in said housing positioned below said piston when said piston is at the top of its stroke; and means comprising the reciprocating motion of said piston for opening the second valve at the top of said upstroke.

11. The improvement in accordance with claim 10 further including packing between said housing and the wall of said well.

12. The improvement in accordance with claim 11 wherein said packing is positioned adjacent the lower end of said housing.

* * * * *